US005971396A

United States Patent [19]

Wieland

[11] Patent Number: 5,971,396

[45] Date of Patent: Oct. 26, 1999

[54] TABLETOP HORSESHOES GAME SYSTEM

[76] Inventor: Terry L. Wieland, 14621 N. 31st Ave., Phoenix, Ariz. 85023

[21] Appl. No.: 09/015,581

[22] Filed: Jan. 29, 1998

[51] Int. Cl.[6] ..... A63B 67/06

[52] U.S. Cl. ..... 273/317.1; 273/338; 473/591

[58] Field of Search ..... 273/317.1, 336, 273/337, 338, 108, 108.1, 126 R, 126 A; 473/591

[56] References Cited

U.S. PATENT DOCUMENTS 3,640,535 2/1972 Gendler ..... 273/126 R
3,690,660 9/1972 Olkowski ..... 273/337

*Primary Examiner*—William H. Grieb
*Attorney, Agent, or Firm*—Martin L. Stoneman

[57] ABSTRACT

A tabletop miniature horseshoes game for use in private residences which includes a substantially horizontal playing surface and a pair of miniature posts to be used as the target for tossed miniature horseshoes. An embodiment for use in commercial establishments provides a token means to activate the game, a means to change and display each players score, a means to keep track of and display game time, and a means to lower the posts when the game is over. The commercial establishment game may also incorporate a vending machine to dispense the 1/10th scale horseshoes to be used with the game.

20 Claims, 4 Drawing Sheets

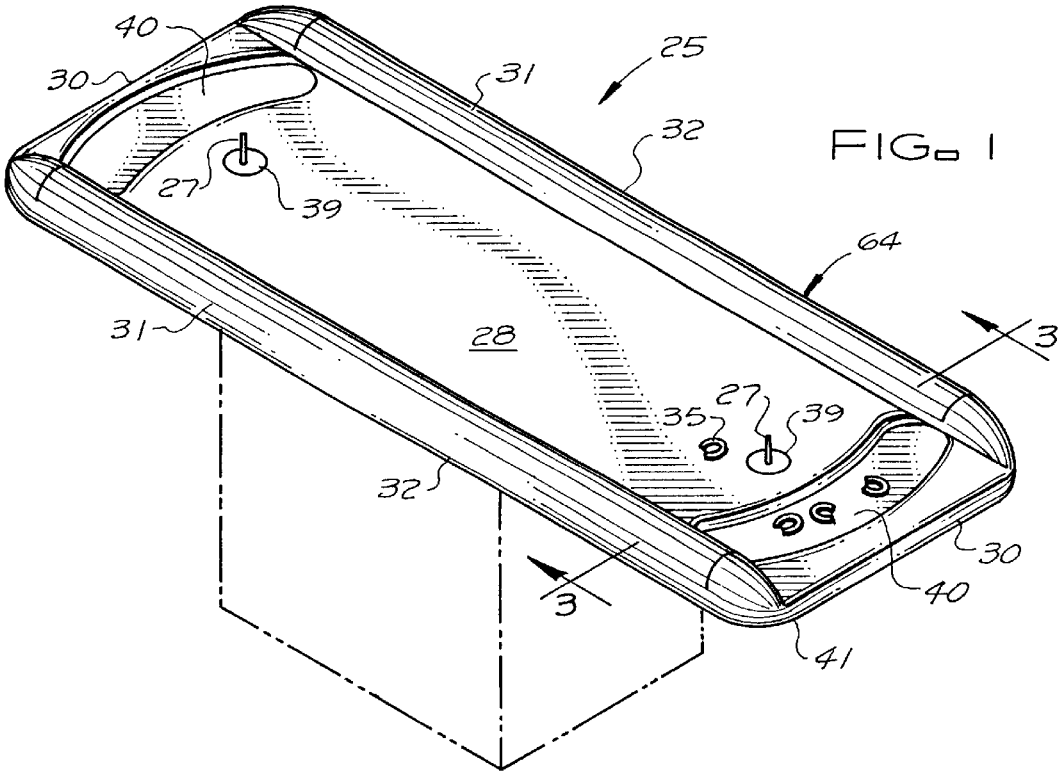
FIG. 1
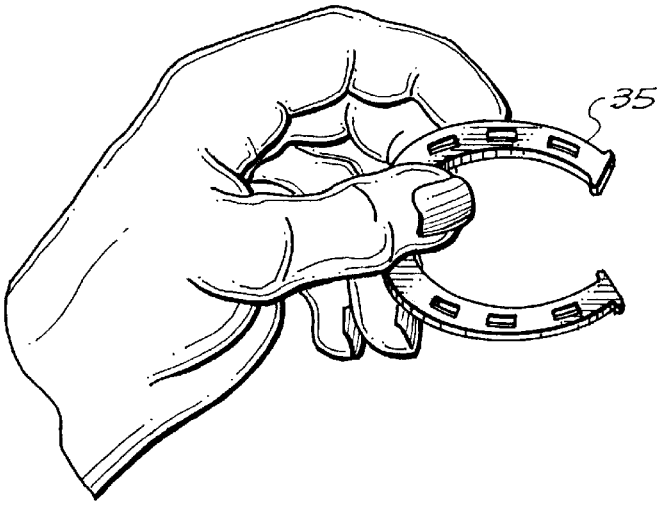
FIG. 2
FIG. 3
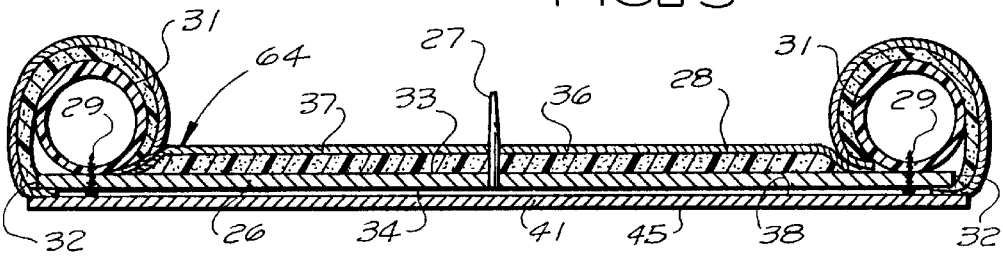

FIG. 4
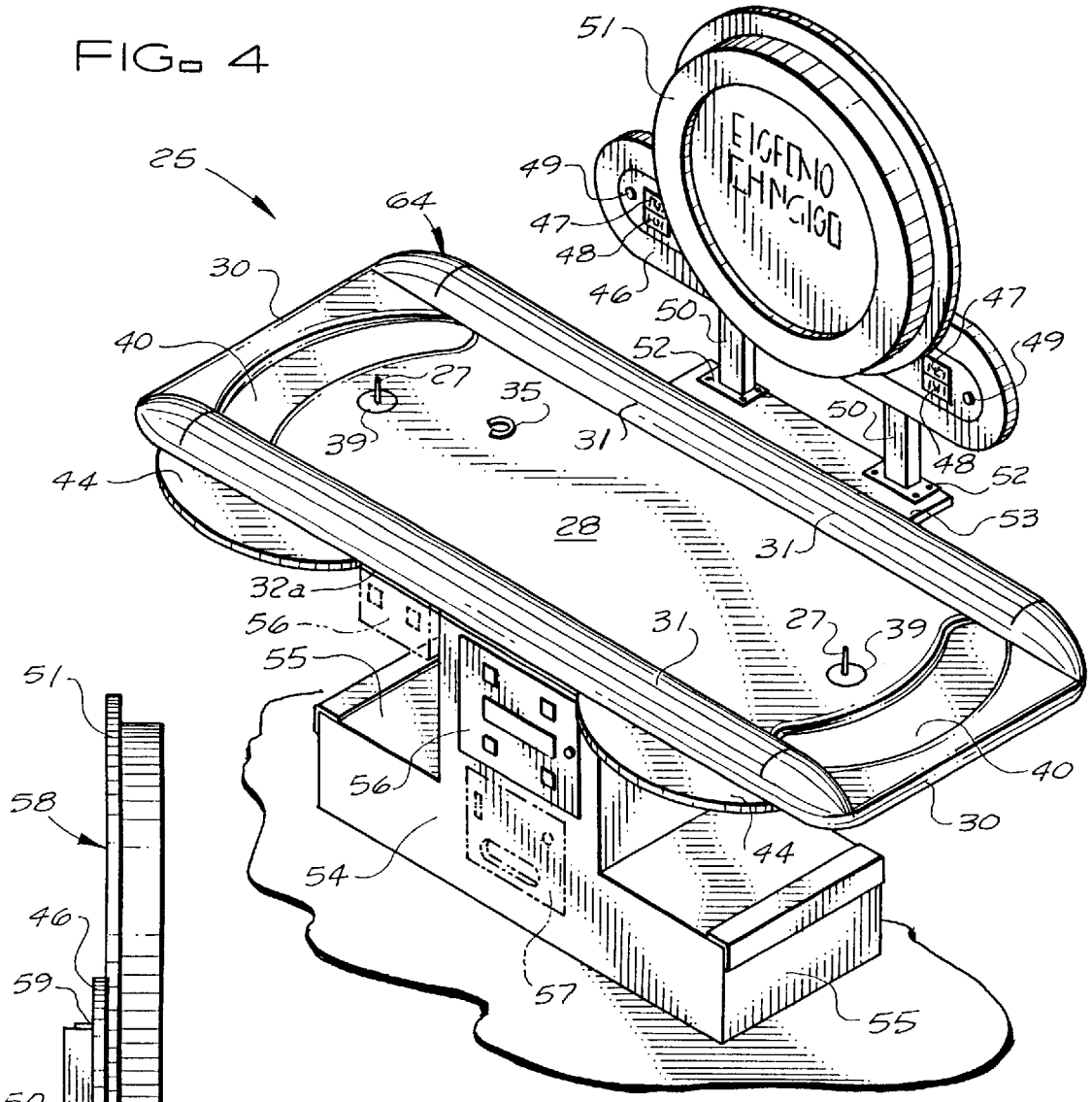
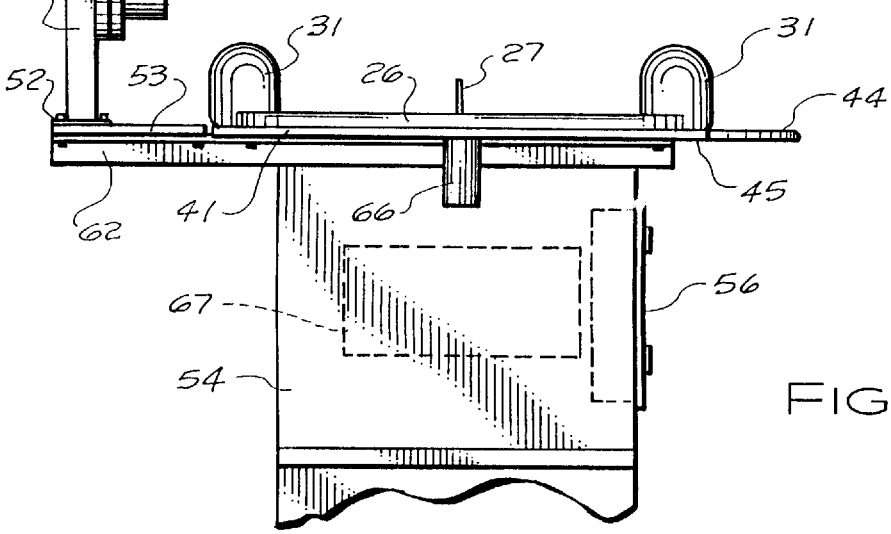
FIG. 5

TABLETOP HORSESHOES GAME SYSTEM

BACKGROUND OF THE INVENTION

1. Field of the Invention

This invention relates to providing a "horseshoes" tabletop game system. More particularly, this invention concerns a novel system for a tabletop "horseshoes" game that may be played either in a private residence or in a commercial establishment.

2. Description of the Prior Art

Typically, in the prior art, to play the well-known game of "horseshoes" requires a playing field of sufficient size to incorporate the conventional distance between the required stakes of approximately 40 feet. Due to the size of the playing field and the need to have a soft substance, such as sand, surrounding the stakes, horseshoes is typically played outdoors and is a game well known throughout the world, although the agreed rules for any particular game are subject to local variation. Briefly, the game is played by players taking turns throwing/pitching a full-size metal horseshoe (often specially made as a large "pitching horseshoe") at a usually-metal vertical stake firmly set in the ground. Each player throws/pitches from about one stake to the other and can score specified points depending upon whether the player makes a "ringer" (if the horseshoe is curled around the stake), a "leaner" (if the it is leaning on the stake), or touching or close within a specified distance, etc., etc.; and a player may move a previously pitched horseshoe to a scoring or non-scoring position as a result of a later pitch. In addition to playing field size limitations, the ability to play conventional horseshoes is subject to other variables such as the weather. In view of the popularity of the sport, and in view of the above-mentioned limitations, there exists a need to provide for this type of entertainment not subject to these limitations.

OBJECTS OF THE INVENTION

A primary object of the present invention is to fulfill the above-mentioned needs by providing a tabletop horseshoes game system. A further primary object of the present invention is to provide such a game system which is inexpensive and easy to use. In addition, it is a primary object of this invention to provide such a game system which may be used in commercial establishments as well as in private homes. Other objects of this invention will become apparent with reference to the following invention descriptions.

SUMMARY OF THE INVENTION

According to a preferred embodiment of the present invention, this invention provides a horseshoes game system comprising: playing board means for providing a substantially horizontal playing surface adapted to be impinged by tossed miniature horseshoes; and, attached to such playing board means, miniature post means for providing a vertical impingeable target for tossed miniature horseshoes. Further, this invention provides such a system wherein such playing surface is longitudinal and has a pair of transverse ends; and a such miniature post means is attached near each such transverse end, with a distance between such miniature post means of about four feet. And it provides such a system further comprising a plurality of miniature horseshoes constructed and arranged for tossing onto such playing surface toward a such miniature post means; and, further, wherein such miniature horseshoes are about 1/10th scale compared to real pitching horseshoes.

In addition, this invention provides such a system further comprising rail means for assisting containment of tossed miniature horseshoes on such playing surface. And it provides such a system wherein such playing board means further comprises: base board means for stiffening such playing board; and padding means for covering and protecting such playing board means; and a cover for covering such padding means. Additionally, it provides such a system wherein such playing board means further comprises catching means for assisting capturing of tossed miniature horseshoes on such playing surface; and still further, wherein such catching means comprises pockets near such transverse ends of such playing surface. Even additionally, this invention provides such a system further comprising post activation means for raising such miniature post means sufficiently above such playing surface to a target position to act as an impingeable target for tossed miniature horseshoes, and for lowering such miniature post means to a non-target position.

Even further, in accordance with a preferred embodiment thereof, the present invention provides a horseshoes game system, comprising: a playing board comprising a substantially horizontal playing surface adapted to be impinged by tossed miniature horseshoes, wherein such playing board is substantially longitudinal and has a pair of transverse ends; a pair of vertical miniature posts constructed and arranged to provide an impingeable target for tossed miniature horseshoes, each such miniature post being located near a such transverse end; and a support means for elevating such playing surface to a tabletop level.

Even additionally, this invention provides such a system further comprising post activation means for raising such pair of vertical miniature posts sufficiently above such playing surface to a target position to act as an impingeable target for tossed miniature horseshoes, and for lowering such pair of vertical miniature posts to a non-target position. And it provides such a system further comprising a game activation means for controlling such post activation means; and further, wherein such game activation means is token-initiated.

Yet still additionally, this invention provides such a system further comprising: rails structured and arranged for assisting containment of tossed miniature horseshoes on such playing surface; and pockets structured and arranged for assisting capturing of tossed miniature horseshoes on such playing surface. And it even further provides such a system further comprising: scorekeeping means for entering players' performances; display means for displaying player's scores; and scoreboard housing means for housing such display means and such scorekeeping means. And it provides such a system further comprising: a timing means for automatically limiting the game playing time; wherein such display means also displays game time remaining; and an electronics means for coordinating the functioning of such post activation means, such scorekeeping means, such timing means, such display means, and such game activation means.

In addition, it provides such a system wherein such playing board further comprises a pair of playing board holes, with one of each such playing board hole being located at each of such pair of transverse ends. And it provides such a system further comprising: a base board structured and arranged for stiffening such playing board and for mechanical attachment to a bottom surface of such playing board; wherein such base board further comprises a pair of base board holes structured and arranged for concentric alignment, respectively, with such pair of playing board holes, and a pair of holder means for holding food containers; and wherein such game activation means is structured and arranged for mechanical attachment to a bottom surface of such base board.

Yet even additionally, this invention provides such a system further comprising: a pair of longitudinal rails located essentially above such playing board; a padding structure substantially covering a top surface of such playing board and both of such pair of longitudinal rails; and a cover covering such padding structure. And it provides such a system further comprising: a vending machine attached to such support means, such vending machine being structured and arranged for dispensing miniature horseshoes having about 1/10th scale compared to real pitching horseshoes.

Moreover, according to a preferred embodiment of this invention, it provides a method of playing a tabletop horseshoes game, comprising the steps of: users inserting a token in a game activation structure to raise miniature horseshoes posts to a playing position on a flat tabletop, to reset a scoring structure, to reset a game timing structure, and to activate a scoring and timing display; users tossing miniature horseshoes at such miniature horseshoes posts; users entering scores in such scoring structure at the end of each turn; and users finishing such game when such display indicates that a winner has achieved a selected score or when such game timing structure registers no time left, whichever first occurs, thereby lowering such miniature horseshoes posts.

BRIEF DESCRIPTION OF THE DRAWINGS

FIG. 1 is a perspective view of a preferred embodiment of the present invention, specifically illustrating a playing surface and the posts connected to the playing surface.

FIG. 2 is an illustration of a miniature horseshoe (about 1/10th scale) that is used to play the game, shown in a hand in a sample position for tossing.

FIG. 3 is a side view, in section but for the post, taken through the section lines 3—3 of FIG. 1 specifically illustrating the arrangement of the playing board, padding, and cover.

FIG. 4 is a perspective view of another preferred embodiment of the present invention, specifically illustrating a commercial-type tabletop horseshoe game with a support, a game activation means, a playing surface, side rails, scoreboard assembly, etc.

FIG. 5 is a left side view of the embodiment of FIG. 4.

DETAILED DESCRIPTION OF A PREFERRED EMBODIMENT AND THE BEST MODE OF PRACTICE

Figure 8:
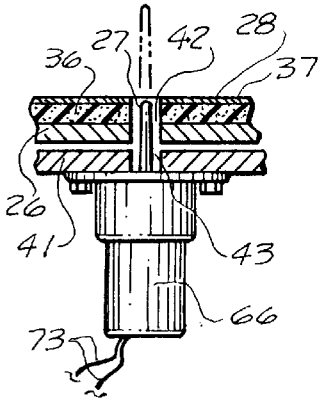
FIG. 8 is an elevation view, partly in section, of the solenoid of the present invention and further illustrating the alternate positions of a post.

FIG. 1 is a perspective view of a preferred embodiment of a tabletop horseshoes game system 25 designed primarily for use in private homes. The game system 25 provides for a playing board 26 (shown in FIG. 3), having a top surface 33 (shown in FIG. 3) and a bottom surface 34 (shown in FIG. 3), preferably constructed from a sheet of substantially rigid yet lightweight material, such as plywood, and preferably having dimensions of approximately 77 inches by 36 inches. Mechanically attached (preferably by pressing a tightly fitting post 27 into hole in playing board 26) to the top surface 33 of the playing board 26 are a pair of posts 27, one post 27 being situate near each transverse end 30 of the playing board 26. The posts 27 are preferably located at a distance of approximately 48 inches from each other. This arrangement embodies in this invention playing board means for providing a substantially horizontal playing surface adapted to be impinged by tossed miniature horseshoes, and attached to such playing board means, miniature post means for providing a vertical impingeable target for tossed miniature horseshoes. A pair of longitudinal rails 31, each preferably made of 2" diameter PVC, are provided for containing the 1/10th scale horseshoes 35 (when tossed) within the area defined by the top surface 33 of the playing board 26. Each rail 31 is mechanically attached (preferably by the use of screws 29) to each side 32 of the playing board 26, as shown in the FIG. 3. Rails 31 embody herein a rail means for assisting containment of tossed miniature horseshoes on such playing surface.

FIG. 3 most clearly illustrates that the playing board 26 and the rails 31 are covered by a padding 36, which, in the preferred embodiment, is a ½"-thick foam material, embodying herein a padding means for covering and protecting such playing board means. Also, as illustrated in FIG. 3, the playing board 26, rails 31, and padding 36 are covered by a decorative and protective covering 37, preferably vinyl. The area defined by the horizontal top surface of the covering 37 after attachment to the padding 36 and playing board 26 combination, and between the longitudinal rails 31, defines the playing surface 28. Imprinted on the covering 37 and encircling each respective post 27 is a scoring circle 39 that is used as a visual scoring aid (as shown in FIG. 1). To prevent the horseshoes from sliding off the playing surface 28, and to provide a convenient place to store the horseshoes 35 when not in play, end pockets 40 are provided at each transverse end 30 of the playing surface 28 in a preferred shallow disc shape as shown in the drawings. In the preferred embodiments, pockets 40, embodying herein a catching means for assisting capturing of tossed miniature horseshoes on such playing surface, are formed by cutting the desired pocket shape from the playing board 26, thereby creating through-holes in the playing board 26. The padding 36 is attached to the playing board 26, preferably by stapling; and the cover 37 is then placed over the padding 36 and pockets 40.

To cover the free ends of the covering 37 and to provide further support for the playing board 26, a base board 41, having a top surface 38 and a bottom surface 45, is mechanically attached, preferably by gluing at its top surface 38 to the bottom surface 34 of the playing board 26. The base board 41, embodying herein a base board means for stiffening such playing board, is constructed from a substantially rigid yet lightweight material, preferably plywood, and has approximately the same dimensions as those of the playing board 26. Thus, FIGS. 1 and 3 show the details of construction of the entire playing assembly 64.

Shown in FIG. 2 is a representative miniature horseshoe 35 that is used in the game system 25 to play the tabletop horseshoes game of the present invention. Preferably, the horseshoes 35 are made from ⅛" stainless steel and are formed by a water chip blasting process. Another preferred method for manufacturing the horseshoes 35 includes laser cutting.

FIG. 4 is a perspective view of another preferred embodiment illustrating a tabletop horseshoe game system 25 designed for use primarily in a commercial establishment. The embodiment of the game system 25 of FIG. 4, similarly to that of FIG. 1, also provides for a playing board 26 (as shown in FIG. 3), having a top surface 33 and a bottom surface 34, constructed from a sheet of substantially rigid yet lightweight material, preferably plywood, and preferably having dimensions of approximately 77 inches by 36 inches. Near each transverse end 30 of the playing board 26 is a playing board post hole 42 (as shown in FIG. 8) of sufficient diameter so as to allow unobstructed vertical movement of each post 27 through each playing board post hole 42. The playing board post holes 42 are preferably located so as to maintain a centerline distance between the posts 27 of approximately 48 inches.

As with the embodiment of FIG. 1, rail 31 is mechanically attached to each side 32 of the playing board 26 for containing the horseshoes 35 within the playing surface 28. Also, this embodiment preferably provides for a padding 36 and covering 37 overlying the top surface 33 of the playing board 26 and rails 31 just as is fully illustrated in FIG. 3. The area defined by the horizontal top surface of the covering 37 after attachment to the padding 36 and playing board 26 combination, and between the longitudinal rails 31, defines a playing surface 28. To cover the free ends of the cover 37 and to provide further support for the playing board 26, a base board 41, having a bottom surface 45 and a longitudinal sides 32, is mechanically attached to the bottom surface 34 of the playing board 26.

Base board post holes 43 (as shown in FIG. 8) are provided near the transverse ends of the base board 41 and are arranged for concentric alignment with the playing board post holes 42. As is more clearly shown in FIG. 8, aligning the playing board post holes 42 with the base board post holes 43 allows each post 27 unobstructed vertical movement. To minimize weight, the base board 41 is constructed from a substantially rigid yet lightweight material, preferably plywood, and has approximately the same dimensions as that of the playing board 26. Playing assembly 64 in this commercial embodiment is very similar to that of the embodiment of FIG. 1, except that in the commercial embodiment provision is made for vertically-movable posts. The game system 25 also provides a pair of table-like holders 44, integral to and located along the front longitudinal side 32*a* of said base board 41, for holding beverages or other food containers while the game system 25 is being played, as shown in FIGS. 4 and 5.

Also shown in FIG. 4 is a scoreboard 46 constructed of a substantially rigid yet lightweight material, preferably plywood. On the scoreboard 46 are mounted a score readout 47, timer readout 48, and a scorekeeping button 49, all items of a kind well known in the art of arcade games and purchasable over-the-counter. The scoreboard 46 is supported in an elevated position by the use of vertical support members 50. This commercial embodiment includes the use of a logo 51 mechanically attached to the front surface of the scoreboard 46. To support the weight of the scoreboard 46 and logo 51, the vertical support members 50 are preferably constructed from a substantially rigid material such as square metal tubing, as shown. Rigidly attached to the lower end of each vertical support member 50 is a vertical support member base 52. Mechanically attached to the bottom surfaces of both of the support member bases 52 is a planar support member 53, all supported in a manner best shown and described with reference to FIG. 6. In this commercial embodiment, the planar support member 53 is constructed out of a lightweight material, preferably plywood.

Mechanically attached to the bottom surface of the base board 41 is a support 54 to be used to support the game and maintain an elevation between the floor and the playing surface 28 of approximately 36 inches. Although this commercial embodiment preferably uses a well-known box frame configuration for the support 54 (embodying herein a support means for elevating such playing surface to a tabletop level), other suitable cross-sectional shapes may be used. To provide a convenient and comfortable place for players to place their feet, this embodiment of the game system 25 provides for a pair of foot stands 55 as an integral part of the support 54. Also included is a game activation means 56, of the kind well known in the art of token/coin-operated machines such as those found in arcades, which is mechanically attached in the face of the support 54, as shown, and embodies herein a game activation means for controlling such post activation means wherein such game activation means is token-initiated.

Further illustrated in FIG. 4 is a horseshoe vending machine 57, mechanically attached to the front surface of the support 54 and of the kind well known in the art of mechanical dispensers, for dispensing the 1/10th scale horseshoes 35. The horseshoe vending machine 57 may be coin or token activated, and upon inserting the appropriate amount of coins or tokens in horseshoe vending machine 57, a predetermined number of miniature horseshoes 35 with which to play the game using game system 25 are dispensed.

FIG. 5 is a left side elevation view of the tabletop horseshoe game system 25 shown in FIG. 4. Further illustrated is scoreboard 46 with a logo 51 attached to the front surface of the scoreboard 46. Preferably, scoreboard 46 is attached to a pair of vertical support members 50 by the use of a substantially longitudinal scoreboard support 59 constructed of a rigid material, preferably angle-iron. The scoreboard 46 is mechanically attached to the vertical surface of the scoreboard support 59 by the use of mechanical fasteners, preferably wood screws passing through pre-drilled holes in the scoreboard support 59 and engaging the back surface of the scoreboard 46. The horizontal surface of the scoreboard support 59 is rigidly attached to the top ends of the vertical support members 50, preferably by welding.

Figure 6:
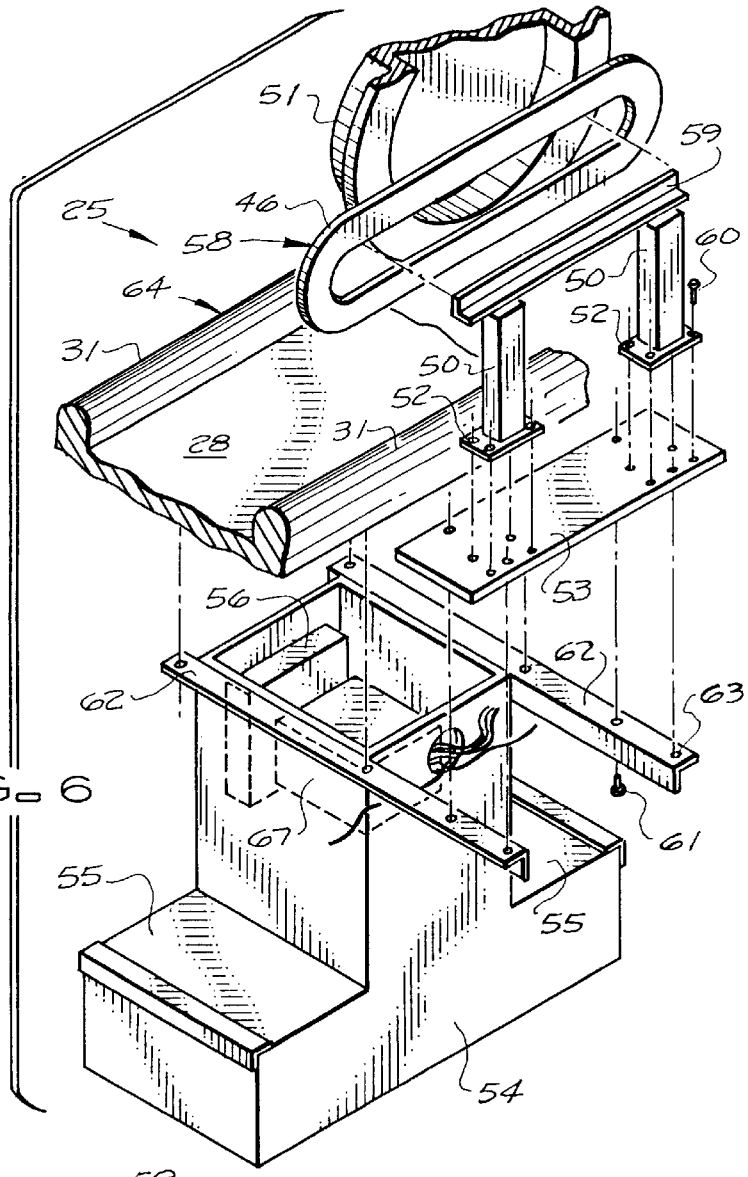
FIG. 6 is an exploded perspective view of the embodiment of FIG. 4.

A vertical support member base 52, having an approximately square shape, is rigidly attached to the bottom ends of the vertical support members 50, again preferably by welding. The vertical support member base 52 is then attached to a planar support member 53 by the use of mechanical fasteners 60 (as shown in FIG. 6) passing through pre-drilled holes in the four corners of the vertical support member base 52 and engaging the upper surface of the planar support member 53. The planar support member 53 is constructed of a lightweight material, preferably plywood. The combination of scoreboard 46, logo 51, scoreboard support 59, vertical support members 50, planar support member 53, and vertical support member bases 52, define a scoreboard housing 58 which is then attached as shown to the bottom surface 45 of the base board 41 by a pair of connecting members 62 (see FIGS. 5 and 6). In order to support the weight of the scoreboard housing 58, the connecting member 62 should be constructed out of a rigid material, preferably angle-iron, and should be of sufficient length to substantially span the length of the base board 41, as shown. To facilitate the attachment of the connecting member 62 to the base board 41 and planar support member 53, holes 63 may be pre-drilled along the horizontal and vertical surfaces of the connecting member 62 to accommodate a plurality of metal fasteners 61 (shown in FIG. 6). The connecting member 62 is then mechanically attached to the outer surface of the top portion of the support 54, the bottom surface of the base board 41, and the bottom surface of the planar support member 53.

Also shown in FIG. 5 is a 24-volt electrically powered solenoid 66, for raising and lowering each post 27, of the type commonly used in arcade games such as pinball, and constructed in a manner well known in the art. In this commercial embodiment, there are two solenoids 66, one each for raising and lowering each post 27. This arrangement embodies in this invention a post activation means for raising such miniature post means sufficiently above such playing surface to a target position to act as an impingeable target for tossed miniature horseshoes, and lowering such miniature post means to a non-target position. Each of the solenoids 66 are arranged for attachment, in well known ways, to the bottom surface 45 of the base board 41. Further illustrated in FIG. 5 is the game activation means 56 mounted on the front surface of the support 54. Also shown is the approximate location of the central electronics 67 used to coordinate the interaction of the electronic components of the game system 25, all hereinafter more fully explained with respect to FIG. 9 and embodying herein an electronics means for coordinating the functioning of such post activation means, such scorekeeping means, such timing means, such display means, and such game activation means. The location of the central electronics 67 is within and attached to the box-frame structure comprising the support 54, though other suitable places of attachment may be used.

FIG. 6 is an exploded view, in perspective, of the illustrated commercial embodiment, specifically showing the details of the interrelationship of the main components comprising the game system 25. It is noted again that the scoreboard housing 58 is connected with game system 25 by the use of connecting members 62. It is also noted that the central electronics 67 for coordinating the interaction of the electronic components of the game system 25 is hereinafter more fully explained with respect to FIG. 9. The location of the central electronics 67 is within and attached to the box-frame structure comprising the support 54, as shown, though other places of attachment may be used. It is also noted that, in order to emphasized other details in FIG. 6, the various parts of the playing assembly 64 (detailed already, for example, in FIG. 3, but for the movable posts) are not shown in this figure.

Figure 7:
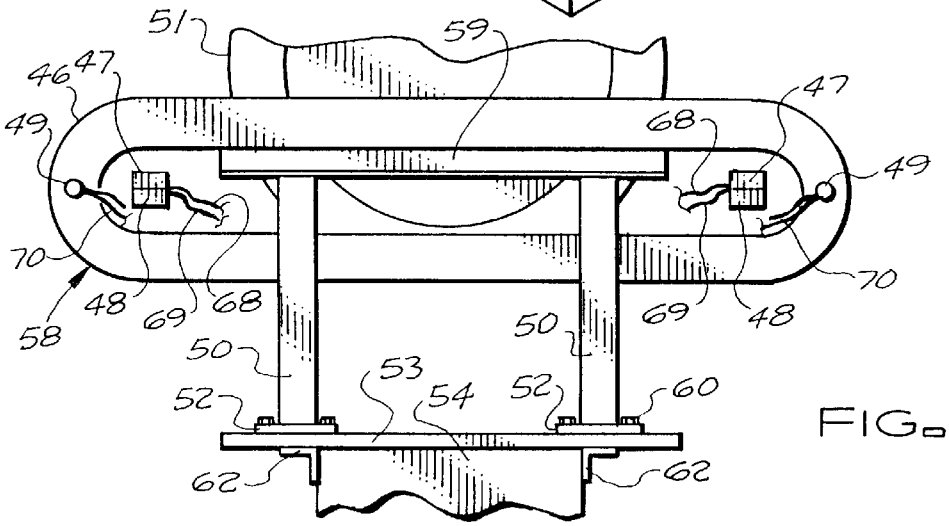
FIG. 7 is a back elevation view of the embodiment of FIG. 4, specifically illustrating the scoreboard assembly as well as the location of the scorekeeping and timing means.

FIG. 7 is a partial back elevation view of the illustrated commercial embodiment (of the tabletop horseshoe game system 25 shown in FIG. 4). Specifically illustrated is the scoreboard assembly comprising a scoreboard 46 mechanically attached to a longitudinal scoreboard support 59 which, in turn, is rigidly attached to the top ends of a pair of vertical support members 50. The bottom ends of the vertical support members 50 are attached to a planar support member 53 by the use of a pair of substantially square vertical support member bases 52 which are rigidly attached to the bottom ends of the vertical support members 50. The square vertical support member bases 52 may be provided with through-holes to facilitate attachment to the top surface of the planar support member 53 by mechanical fasteners 60 (FIGS. 6 and 7). Further illustrated are a score readout 47, timer readout 48, and scorekeeping button 49 (all of a kind well known in the art of arcade games) which are housed within apertures cut into the scoreboard 46 and located near each transverse end of the scoreboard 46. The score readout 47, timer readout 48, and scorekeeping button 49 are connected to the central electronics 67 (not shown in FIG. 7) by score readout leads 68, timer readout leads 69, and scorekeeping button leads 70.

The post activation means preferred for use in the illustrated commercial embodiment is shown in FIG. 8. Specifically illustrated is base board 41 having a base board post hole 43 therein, playing board 26 having a playing board post hole 42 therein and structured and arranged for concentric alignment with the base board post hole 43. Also shown is padding 36 overlying the top surface 33 of the playing board 26 and covering 37 overlying padding 36. The post activation means preferred is a 24-volt electrically powered solenoid 66 of the type commonly used in arcade games such as pinball, and constructed in a manner well known in the art. The post 27 is integral to the solenoid 66 and preferably of a sufficient length so as to allow a height of about 1¾ above the playing surface 28 when the solenoid 66 is activated. When the game system 25 is in the "off" mode, either because the winning score has been achieved, or the pre-determined time to play the game has elapsed, current ceases to flow through the solenoid coils 90 (shown in FIG. 9) located within each solenoid 66, with the result that the internal electromagnetic field inside each solenoid 66 is turned off. When this occurs, each post 27 is retracted so that the top end of each post 27 is at or below the playing surface 28. Conversely, when the game is activated by placing an appropriate token in the game activation means 56, an electrical signal is sent from the central electronics 67 to the solenoids 66, energizing the solenoid coils 90 (shown in FIG. 9) thereby raising each post 27 to the appropriate playing height.

Figure 9:
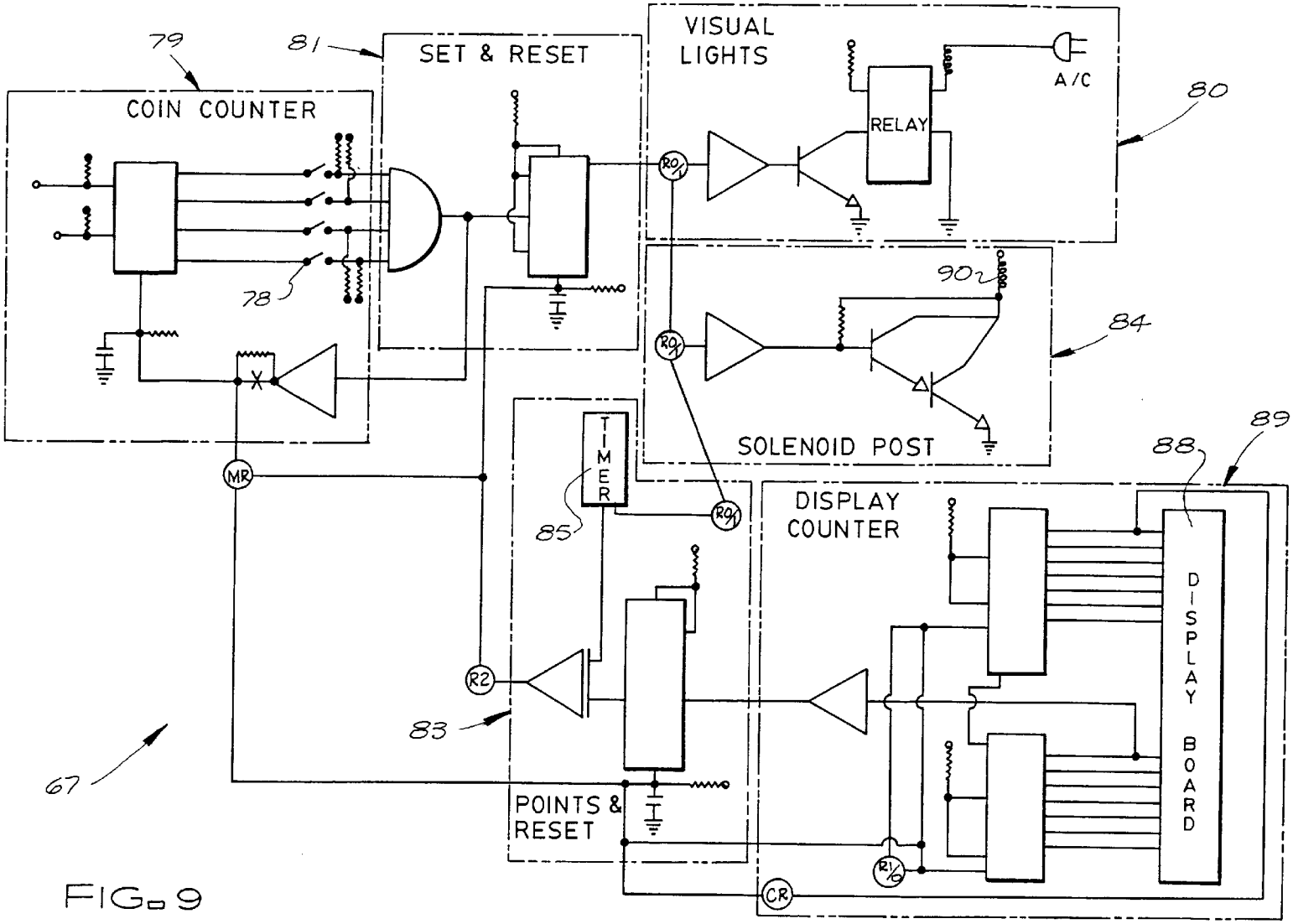
FIG. 9 is a schematic illustration showing a preferred electrical configuration for the central electronics for use in the embodiment of FIG. 4.

FIG. 9 is a schematic view of the central electronics 67 preferably used in the illustrated commercial embodiment of the tabletop horseshoes game system 25. The operation of the central electronics 67 is described as follows, but should be within the art of those skilled in the art of arcade electronics. The game system 25 is activated by having a player deposit the appropriate amount of tokens in the game activation means 56. When the appropriate amount of coins or tokens are deposited, electronic switches 78 in the coin counter circuit 79 are closed, thereby allowing current to pass, and to simultaneously activate the game system 25 visual lights by means of the visual-lights circuit 80, the set and reset circuit 81, the points and reset circuit 83, and the solenoid post circuit 84. Upon energizing the set and reset circuit 80, the timer 85, as well as the internal electronic calculation of the number of points scored, is reset to "0" as displayed on the timer readout 48 and score readout 47, both illustrated generally by the display board designation 88 which comprises part of the display counter circuit 89. Preferably, an Intel 4076B microprocessor is used for the display counter means, and an Intel 4520B microprocessor is used for the coin counter circuit. Simultaneous with the score and time being reset to "0", an electromagnetic field is created within the solenoid coils 90 which causes each post 27 (not shown in FIG. 9), which are integral to the solenoids 66, to raise to a preferred playing height above the playing surface 28. As points are scored, the scorekeeping button 49 (not shown in FIG. 9) is pressed, thereby changing the count displayed on the score readout 47. When the requisite number of points have been earned by a player, or if the pre-determined time to play a game has elapsed as evidenced by the timer readout 48, the game system 25 is deactivated thereby shutting off the current to the solenoids 66 resulting in the retraction of each post 27 below the playing surface 28, and thereby ending the game. Though applicant has described the preferred embodiment of the central electronics 67, the addition of other types of circuits, well known in the art of arcade games such as tilt sensors to stop rough play, may be added without deviating from the spirit of the present invention.

The private residence version of the game is preferably played by having each player, being situated at the transverse ends 30 of the playing board 26, toss a 1/10th scale horseshoe 35 at the opponent's post 27 located at the opposite transverse end. In order to maintain a degree of difficulty and to ensure fair play, when tossing a horseshoe a player's hand may not cross the transverse plane situated at the location of that player's post. Each player's turn consists of pitching two horseshoes 35 and a player scores 3 points if the horseshoe 35 "rings" (encircles) the post 27, 2 points for a "leaner" in which the horseshoe comes to a rest by leaning against the post 27, 1 point if the horseshoe touches the post 27 but does not lean against it, and 1 point if the horseshoe touches or breaks the line comprising the scoring circle 39. The first player to obtain a score of 21 points wins the game though other winning scores may be used by the players without deviating from the spirit of the game.

To play the commercial version of the game system 25 requires that the players insert the appropriate amount of coins or tokens in the game activation means 56. Once the game system 25 is activated, the players have a pre-determined period of time in which to play. Preferably, the playing time is set between 15 and 30 minutes, though other playing times may also be chosen. The players may obtain the horseshoes 35 to be used in order to play the game system 25 in a number of ways including renting them from the commercial establishment, purchasing their own either from a vending machine in the commercial establishment or from the vending machine 57 incorporated in the game system 25 (as shown in FIG. 4), or by using previously bought horseshoes 35. The game system 25 is then played according to the same rules and scoring scheme as the private residence version except that if either player does not obtain a score of 21 points prior to the expiration of the pre-determined time limit, the game will automatically end. This system embodies herein a method of playing a tabletop horseshoes game, comprising the steps of: users inserting a token in a game activation structure to raise miniature horseshoes posts to a playing position on a flat tabletop, to reset a scoring structure, to reset a game timing structure, and to activate a scoring and timing display; users tossing miniature horseshoes at such miniature horseshoes posts; users entering scores in such scoring structure at the end of each turn; and users finishing such game when such display indicates that a winner has achieved a selected score or when such game timing structure registers no time left, whichever first occurs, thereby lowering such miniature horseshoes posts.

Although applicant has described applicant's preferred embodiment of this invention, it will be understood that the broadest scope of this invention includes such modifications as diverse shapes, sizes, and materials. Such scope is limited only by the below claims as read in connection with the above specification.

Further, many other advantages of applicant's invention will be apparent to those skilled in the art from the above descriptions and the below claims.

What is claimed is:

1. A horseshoes game system comprising:

a. playing board means for providing a substantially horizontal playing surface adapted to be impinged by tossed miniature horseshoes;

b. attached to said playing board means, miniature post means for providing a vertical impingeable target for tossed miniature horseshoes; and c. wherein said playing board means comprises a padding means for providing a compressible surface for effecting impingement of said tossed miniature horseshoes.

2. A horseshoes game system according to claim 1 wherein:

a. said playing surface is longitudinal and has a pair of transverse ends; and b. a said miniature post means is attached near each said transverse end, with a distance between said miniature post means of about four feet.

3. A horseshoes game system according to claim 2 further comprising:

a. a plurality of miniature horseshoes constructed and arranged for tossing onto said playing surface toward a said miniature post means.

4. A horseshoes game system according to claim 3 wherein said miniature horseshoes are about 1/10th scale compared to real pitching horseshoes.

5. A horseshoes game system according to claim 1, further comprising:

a. rail means for assisting containment of tossed miniature horseshoes on said playing surface.

6. A horseshoes game system according to claim 1 wherein said playing board means further comprises:

a. base board means for stiffening said playing board means; and b. a cover for covering said padding means.

7. A horseshoes game system according to claim 6 wherein said playing board means further comprises:

a. catching means for assisting capturing of tossed miniature horseshoes on said playing surface.

8. A horseshoes game system according to claim 7 wherein said catching means comprises pockets near said transverse ends of said playing surface.

9. A horseshoes game system comprising:

a. playing board means for providing a substantially horizontal playing surface adapted to be impinged by tossed miniature horseshoes;

b. attached to said playing board means, miniature post means for providing a vertical impingeable target for tossed miniature horseshoes; and c. post activation means for:

i. raising said miniature post means sufficiently above said playing surface to a target position to act as an impingeable target for tossed miniature horseshoes; and ii. lowering said miniature post means to a non-target position.

10. A horseshoes game system, comprising:

a. a playing board comprising a substantially horizontal playing surface adapted to be impinged by tossed miniature horseshoes, wherein said playing board is substantially longitudinal and has a pair of transverse ends;

b. a pair of vertical miniature posts constructed and arranged to provide an impingeable target for tossed miniature horseshoes, each said miniature post being located near a said transverse end;

c. a support means for elevating said playing surface to a tabletop level; and d. a padding structure substantially covering a top surface of said playing board; and e. wherein said padding structure comprises a substantially foam material.

11. A horseshoes game, comprising:

a. a playing board comprising a substantially horizontal playing surface adapted to be impinged by tossed miniature horseshoes, wherein said playing board is substantially longitudinal and has a pair of transverse ends;

b. a pair of vertical miniature posts constructed and arranged to provide an impingeable target for tossed miniature horseshoes, each said miniature post being located near a said transverse end;

c. a support means for elevating said playing surface to a tabletop level; and d. post activation means for:

i. raising said pair of vertical miniature posts sufficiently above said playing surface to a target position to act as an impingeable target for tossed miniature horseshoes; and ii. lowering said pair of vertical miniature posts to a non-target position.

12. A horseshoes game system according to claim 11, further comprising:

a. game activation means for controlling said post activation means.

13. A horseshoes game system according to claim 12 wherein said game activation means is token-initiated.

14. A horseshoes game system according to claim 13, further comprising:

a. rails structured and arranged for assisting containment of tossed miniature horseshoes on said playing surface; and b. pockets structured and arranged for assisting capturing of tossed miniature horseshoes on said playing surface.

15. A horseshoes game system according to claim 12, further comprising:

a. scorekeeping means for entering players' performances;

b. display means for displaying player's scores; and c. scoreboard housing means for housing said display means and said scorekeeping means.

16. A horseshoes game system according to claim 15, further comprising:

a. a timing means for automatically limiting the game playing time;

b. wherein said display means also displays game time remaining; and c. an electronics means for coordinating the functioning of said post activation means, said scorekeeping means, said timing means, said display means, and said game activation means.

17. A horseshoes game system according to claim 12 wherein said playing board further comprises a pair of playing board holes, with one of each said playing board hole being located at each of said pair of transverse ends, and said horseshoes game system further comprising:

a. a base board structured and arranged for stiffening said playing board and for mechanical attachment to a bottom surface of said playing board;

b. wherein said base board further comprises i. a pair of base board holes structured and arranged for concentric alignment, respectively, with said pair of playing board holes, and ii. a pair of holder means for holding food containers; and c. wherein said game activation means is structured and arranged for mechanical attachment to a bottom surface of said base board.

18. A horseshoes game system according to claim 12 further comprising:

a. a pair of longitudinal rails located essentially above said playing board;

b. a padding structure substantially covering a top surface of said playing board and both of said pair of longitudinal rails; and c. a cover covering said padding structure.

19. A horseshoes game system according to claim 12 further comprising:

a. a vending machine attached to said support means, said vending machine being structured and arranged for dispensing miniature horseshoes having about 1/10th scale compared to real pitching horseshoes.

20. A method of playing a tabletop horseshoes game, comprising the steps of:

a. users inserting a token in a game activation structure to raise miniature horseshoes posts to a playing position on a flat tabletop, to reset a scoring structure, to reset a game timing structure, and to activate a scoring and timing display;

b. users tossing miniature horseshoes at said miniature horseshoes posts;

c. users entering scores in said scoring structure at the end of each turn; and d. users finishing said game when said display indicates that a winner has achieved a selected score or when said game timing structure registers no time left, whichever first occurs, thereby lowering said miniature horseshoes posts.

* * * * *